US005970669A

United States Patent [19]

Livingston

[11] Patent Number: 5,970,669

[45] Date of Patent: Oct. 26, 1999

[54] MOLDING STRIPS FOR FABRIC WALL AND CEILING SYSTEMS

[76] Inventor: Bryan K. Livingston, 2533 Waits Ave., Fort Worth, Tex. 76109

[21] Appl. No.: 09/074,456

[22] Filed: May 8, 1998

[51] Int. Cl.[6] ..... E04B 1/00

[52] U.S. Cl. ..... 52/222; 160/327; 24/562; 24/555

[58] Field of Search ..... 52/222, 716.3, 52/716.8, 717.01, 720.1, 791.1; 24/562, 555; 160/327, 391, 392, 395, 368.1, 371

[56] References Cited

U.S. PATENT DOCUMENTS 4,788,806 12/1988 Sease ..... 52/222
4,920,714 5/1990 Sease ..... 160/392 X
5,214,891 6/1993 Edlin ..... 52/222
5,214,892 6/1993 Livingston et al. .

*Primary Examiner*—David M. Purol
*Attorney, Agent, or Firm*—Nixon & Vanderhye

[57] ABSTRACT

The molding strip includes a base, first and second walls each having a non-gripping section and a gripping section on the side of the non-gripping section remote from the base. The gripping section includes a plurality of teeth having long and short sides. The long sides face outwardly of the molding strip to facilitate insertion of the fabric between the teeth and into the collection cavity defined by the non-gripping sections and base. In a preferred form, one of the walls inclines toward the opposing wall, with the gripping sections lying parallel to one another, whereby a single bevel cut on the core panel may be made to facilitate installation of the molding strip onto the panel.

18 Claims, 5 Drawing Sheets

MOLDING STRIPS FOR FABRIC WALL AND CEILING SYSTEMS

TECHNICAL FIELD

The invention is generally related to stretched fabric panels used for architectural and acoustic interior treatments and, more particularly, to molding strips used to secure the stretched fabric to a support surface such as a ceiling or wall.

BACKGROUND

Architectural fabric ceiling and wall systems have been used for several years to enhance interior acoustics and the appearance of interior spaces in homes, buildings, rooms, and the like. These systems can provide color, texture, and three-dimensional features to a ceiling or wall which cannot be duplicated by other surface treatments. Typically, these systems include a number of extruded pieces which frame an area over which a fabric is stretched. The extruded pieces are affixed to a support structure such as a wall or ceiling using screws, nails, adhesives, or other securing means as appropriate, and have a retaining mechanism for retaining the fabric. The area which is framed by the extruded pieces can be any shape or size. After the extruded pieces frame the area, the fabric is stretched over the frame and secured in the retaining mechanism. The fabric can be any material which can be held by the retaining mechanism of the extruded pieces. The fabric is often a cloth material, and the cloth may be textured or patterned with a design.

The retaining mechanisms which have been employed in prior art systems typically include a pair of spring-biased walls which have opposing jaw members. In operation, the fabric is pushed between the jaws using a knife or other suitable flat object. The fabric accumulates in a cavity between the jaw members, and, if necessary, can be trimmed using a knife or shears at the location of the retaining mechanism after it is inserted into the cavity. The exposed trimmed edge is then fully inserted into the cavity using a knife-type tool. Because the extruded members provide a frame for the area of interest, the procedure of stretching the fabric over the frame and stuffing the fabric into the retaining mechanism region of the frame members assures that a smooth fabric surface is presented. The framed unit is often referred to as a stretch fabric "panel."

The fabric panel may be positioned over a tackable core material, such as, for example, in wall applications where it is desired to permit pictures and other objects to be hung on the wall over the fabric panel. In addition, the fabric panel may be positioned over acoustical core materials (i.e., fibrous or foam insulation) which attenuates sound, as would be needed in auditoriums or recording studios. Furthermore, electronic equipment such as speakers, microphones, and the like, may be positioned behind the fabric panel within a mounting frame or region. The choice of material used for the fabric will depend on the application. In acoustic applications, it will be desirable to use loose weave materials which will allow free passage of air between the room and the sound attenuating foam or fibrous material. This will allow, in the case of embedded speakers, sound to be projected clear and undistorted into the room from the speaker, and, in the case of using acoustical cores to deaden undesirable noise, will prevent undesirable noise from being reflected into the room. For wall or ceiling applications which are decorative in purpose, fabrics with a tighter weave and other specific characteristics will be preferred.

The panels need not be rectangular in shape. In fact, the edges of several adjacent fabric panels can be organized in a manner which creates parallelograms, triangles, and other geometric shapes on the treated wall surface. In addition, the extruded pieces can be fashioned so as to create bevels, curves and spaces between adjacent panels.

Several patents describe stretch fabric panel systems. These include U.S. Pat. Nos. 4,631,882; 4,731,960 and 4,788,806, all to Sease; U.S. Pat. Nos. 4,018,260; 4,053,008; 4,151,672; 4,161,977; 4,197,686 and 4,625,490, all to Baslow; and U.S. Pat. Nos. 5,117,598 and 5,214,892, both to Livingston et al. Each of these patents is herein incorporated by reference.

It has been commonly thought that the configuration and operation of the jaw members should be such as to positively prevent fabric dislodgement from the extruded moldings. This was a result of the recognition that if the fabric was dislodged during or after installation, the fabric would have an undesirable and non-smooth finish and underlying elements such as acoustical cores would become noticeable. To cure the problem of fabric dislodgement, a molding strip has been designed comprising an extrusion extending in a longitudinal direction having a base with first and second flexible gripping walls projecting from the base. Each projecting wall has a gripping section in opposition to a gripping section of the opposing wall, with specifically configured and arranged teeth for gripping the fabric in the fabric entry region to the fabric collection cavity defined by the base and walls. The teeth of the fabric gripping sections of the walls were specifically designed to have sloping surfaces facing outwardly of the molding strip and short surfaces extending generally parallel with the base of the molding strip. The short and long surfaces terminate at points such that the points of the teeth in one of the gripping sections lie between the points of the teeth in the other gripping section. That is, the point of each of the plurality of teeth of one gripping section projects between a corresponding pair of teeth of the other gripping section and vice-versa, so that in the absence of a secured fabric, the teeth mesh with one another but without contact. That toothed configuration facilitated entry of the fabric through the entry slot between the teeth of the gripping sections because of the outwardly angled facing portions of the teeth, while at the same time, preventing dislodgement of the fabric from the fabric-receiving cavity. Thus, the fabric is, in effect, clamped between each of the tooth tips and a sloped surface of an opposite tooth. While that toothed configuration and arrangement of teeth solved the problem of fabric dislodgement, it has been found that the fabric cannot be removed once inserted without damage to the fabric. As will be appreciated, a major benefit of a fabric wall system for use in commercial interiors is the capacity to remove the fabric without damage for replacement, repair or change of fabric.

Further, the walls of molding strips of this type have in the past been configured to define generally rectangular fabric collection cavities. That is, one of the walls typically projects generally at right angles to the base of the molding strip. The other or second wall, spaced from the first wall, projects at right angles and then turns toward the first wall generally parallel to the base and turns again to form a gripping section with the gripping section of the first wall. This type of molding strip configuration requires the underlying panel, i.e., fiberglass board, to be cut in a rectilinear fashion. That is, a two-sided rabbet-type groove must be formed along the edge of the panel to enable the molding strip to fit flush with the surface of the panel. The installer must perform two cutting operations to form the rabbet in order for the rabbet to receive the molding strip. It will be appreciated that this requires substantial additional labor at the installation site. Further, the molding strip with the foregoing configuration has a degree of undesired flexibility because of the rectilinear configuration of the strip defining the fabric collection cavity. That configuration imposes additional undesired stresses at the juncture of the second wall with the base.

Further, prior molding strip designs did not permit angled insertion of the fabric into the gripping sections of the molding strip. Aesthetically, it would be desirable to form a drop-leg or recessed outer wall. This cannot be accomplished with existing molding strip designs.

DISCLOSURE OF THE INVENTION

In accordance with the present invention, there is provided a novel and improved molding strip for a fabric wall and ceiling system which both prevents unintended fabric dislodgement and facilitates removal of the fabric from the strip, thereby overcoming the problem of damage to the fabric upon removal or dislodgment of the fabric, affording a molding strip configuration which eliminates a second cut of the underlying panel during installation of the molding strip and additionally providing in one form hereof an angled fabric entry slot, rendering a drop-leg or recessed outer wall panel possible. To accomplish the foregoing, the present invention provides a plastic extrusion extending in a longitudinal direction having a base forming a wall contact surface for securement to the underlying panel and a pair of walls projecting from the base having non-gripping sections and gripping sections distally of the base. One of the walls extends generally at right angles from the base, while the other wall has a proximal portion spaced from the proximal portion of the first wall adjoining the base and extending toward the first wall at an angle. Both walls have distal portions terminating in the generally parallel extending gripping sections. Thus, it will be appreciated that the non-gripping sections of the walls and the base form a generally triangular fabric-receiving collection cavity. Outwardly of the gripping sections, the walls are extended to provide a fabric entry slot for guiding the fabric into and past the gripping sections of the molding strip.

The gripping sections each have a plurality of teeth, with each tooth having a long and a short side, the long side being further away from the fabric collection cavity than the short side of the tooth. The short side of each tooth extends generally parallel to the base. The points of the teeth of the gripping sections are aligned with the respective points of the teeth of the opposing gripping section, the aligned teeth lying in spaced planes generally parallel to the base. With this arrangement, fabric insertion through the fabric entry slot and past the gripping sections is facilitated by the sloped long sides of the teeth. By locating the fabric between opposite tips of the teeth, only one fabric gripping point is provided for each pair of teeth. This reduces the number of gripping points for a given number of teeth and desirably reduces the fabric gripping force in comparison with the aforementioned prior art design while maintaining adequate fabric retention forces. Additionally, with at least one of the walls being flexible and with the reduced number of gripping points, fabric removal from between the gripping sections is facilitated and without damage to the fabric being removed.

It will be appreciated that the angled wall portion of the molding strip facilitates installation of the molding strip onto the underlying panel. By angling the non-gripping section of the second wall from the base and toward the opposite first wall, a single pass or cut along the margin of the underlying panel may be made without any additional cuts. The cut is in the nature of a bevel along the panel edge, thus minimizing the labor involved in cutting the panel to receive the molding strip. Additionally, the angled wall reduces the amount of plastic material in the molding strip and affords a stiffer moment arm. While the stiffer moment arm causes an increase in the spring force necessary to spread the walls apart, the arrangement of the teeth of the gripping sections minimizes or eliminates any damage to the fabric being removed or dislodged from the molding strip.

In a further form of the present invention, the teeth of the gripping sections have the foregoing described long and short sides and orientation vis-a-vis the fabric entry slot. However, the teeth are arranged differently along the gripping sections. For example, in this further preferred embodiment, the teeth along each gripping section are spaced one from the other, providing lands between the teeth which lie parallel to the walls of the gripping sections. The teeth on one gripping section lie in opposition to the lands on the other gripping section, and vice-versa. Preferably, the points of the teeth of each gripping section engage the lands prior to fabric insertion and thus naturally engage the fabric against the lands after fabric insertion. In one further form hereof, the lands have recesses for receiving the points of the teeth as well as the fabric after fabric insertion.

In a still further form of tooth configuration and arrangement, the long side and short sides of each tooth may have an arcuate configuration, with the long side having a greater radius of curvature and facing the fabric entry slot. The curved teeth of the gripping sections are misaligned relative to one another with the points of the teeth bearing against the long arcuate surfaces of the opposing teeth prior to fabric insertion and engaging the fabric against the long arcuate surfaces of the opposing teeth after fabric insertion.

In a preferred embodiment according to the present invention, there is provided a molding strip for a fabric panel, comprising a base, first and second walls extending from the base, the first and second walls each having first and second gripping sections, respectively, extending generally parallel to one another and spaced away from the base by respective first and second non-gripping sections, the first and second gripping sections lying in opposition to one another, the first non-gripping section on the first wall being spaced away from the second non-gripping section on the second wall, the base and the first and second non-gripping sections defining a fabric collection cavity, at least one of the first and second walls being movable to a position enabling fabric material to pass between the first and second gripping sections of the first and second walls, respectively, into the fabric collection cavity, first and second fabric gripping teeth positioned on the first and second fabric gripping sections, respectively, each of the first and second fabric gripping teeth having a long side and a short side meeting at a point, the long side being relatively further away from the fabric collection cavity than the short side, the short sides of the teeth projecting from each of the first and second gripping sections in a direction substantially perpendicular to the gripping sections, the point of each tooth being generally oriented closer to the fabric collection cavity than a long side of the tooth, the points of the teeth of the first gripping section being aligned with respective points of teeth of the second gripping section in a direction generally perpendicular to the generally parallel extending gripping members.

In a further preferred embodiment according to the present invention, there is provided a molding strip for a fabric panel, comprising a base, first and second walls extending from the base, the first and second walls having first and second gripping sections, respectively, extending generally parallel to one another and spaced away from the base by respective first and second non-gripping sections, the first and second gripping sections lying in opposition to one another, the first non-gripping section on the first wall being spaced away from the second non-gripping section on the second wall, the base and the first and second non-gripping sections defining a fabric collection cavity, at least one of the first and second walls being movable to a position enabling fabric material to pass between the first and second gripping sections of the first and second walls, respectively, into the fabric collection cavity, first and second fabric gripping teeth positioned on the first and second fabric gripping sections, respectively, each of the first and second fabric gripping teeth having a long side and a short side meeting at a point, the long side being relatively further away from the fabric collection cavity than the short side, the point of each tooth being generally oriented closer to the fabric collection cavity than a long side of the tooth, the first wall having a first wall portion on an opposite side of the first gripping section from the first non-gripping section, the second wall having a second wall portion on an opposite side of the second gripping section from the second non-gripping section, the first and second wall portions defining a fabric entry slot for directing fabric between the teeth of the gripping sections, the first and second non-gripping sections of the first and second walls, respectively, extending in non-parallel planes relative to one another, with proximal portions of the first and second non-gripping sections adjacent the base being spaced from one another a distance greater than the spacing between distal portions thereof adjacent respective first and second gripping sections.

In a still further preferred embodiment according to the present invention, there is provided a molding strip for a fabric panel, comprising a base, first and second walls extending from the base, the first and second walls having first and second gripping sections, respectively, extending generally parallel to one another and spaced away from the base by respective first and second non-gripping sections, the first and second gripping sections lying in opposition to one another, the first non-gripping section on the first wall being spaced away from the second non-gripping section on the second wall, the base and the first and second non-gripping sections defining a fabric collection cavity, at least one of the first and second walls being movable to a position enabling fabric material to pass between the first and second gripping sections of the first and second walls, respectively, into the fabric collection cavity, first and second fabric gripping teeth positioned on the first and second fabric gripping sections, respectively, each of the first and second fabric gripping teeth having a long side and a short side meeting at a point, the long side being relatively further away from the fabric collection cavity than the short side, the teeth on each gripping section being spaced from one another to define lands therebetween, the lands of the gripping sections lying in generally parallel spaced relation relative to one another, the points of the teeth of each gripping section lying in engagement with the lands between the teeth of another of the gripping sections, at least one of the walls being flexible, enabling the gripping section carried thereby for movement away from another of the gripping sections to permit insertion of fabric between the gripping sections with the points of the teeth of each gripping section engaging the fabric against the lands of the opposing gripping section.

In a still further preferred embodiment according to the present invention, there is provided a molding strip for a fabric panel, comprising a base, first and second walls extending from the base, the first and second walls having first and second gripping sections, respectively, extending generally parallel to one another and spaced away from the base by respective first and second non-gripping sections, the first and second gripping sections lying in opposition to one another, the first non-gripping section on the first wall being spaced away from the second non-gripping section on the second wall, the base and the first and second non-gripping sections defining a fabric collection cavity, at least one of the first and second walls being movable to a position enabling fabric material to pass between the first and second gripping sections of the first and second walls, respectively, into the fabric collection cavity, first and second fabric gripping teeth, positioned on the first and second fabric gripping sections, respectively, each of the first and second fabric gripping teeth having a long side and a short side meeting at a point, the long side being relatively further away from the fabric collection cavity than the short side, the long side of each tooth being arcuate with the points of each tooth being directed toward the arcuate long side of opposing teeth of the opposing gripping section.

Accordingly, it is a primary object of the present invention to provide novel and improved molding strips for fabric wall and ceiling systems specifically configured to minimize or eliminate damage to the fabric upon dislodgement or removal of the fabric from the molding strip and to facilitate installation of the strips on the underlying panel.

BEST MODE FOR CARRYING OUT THE INVENTION

Figure 1:
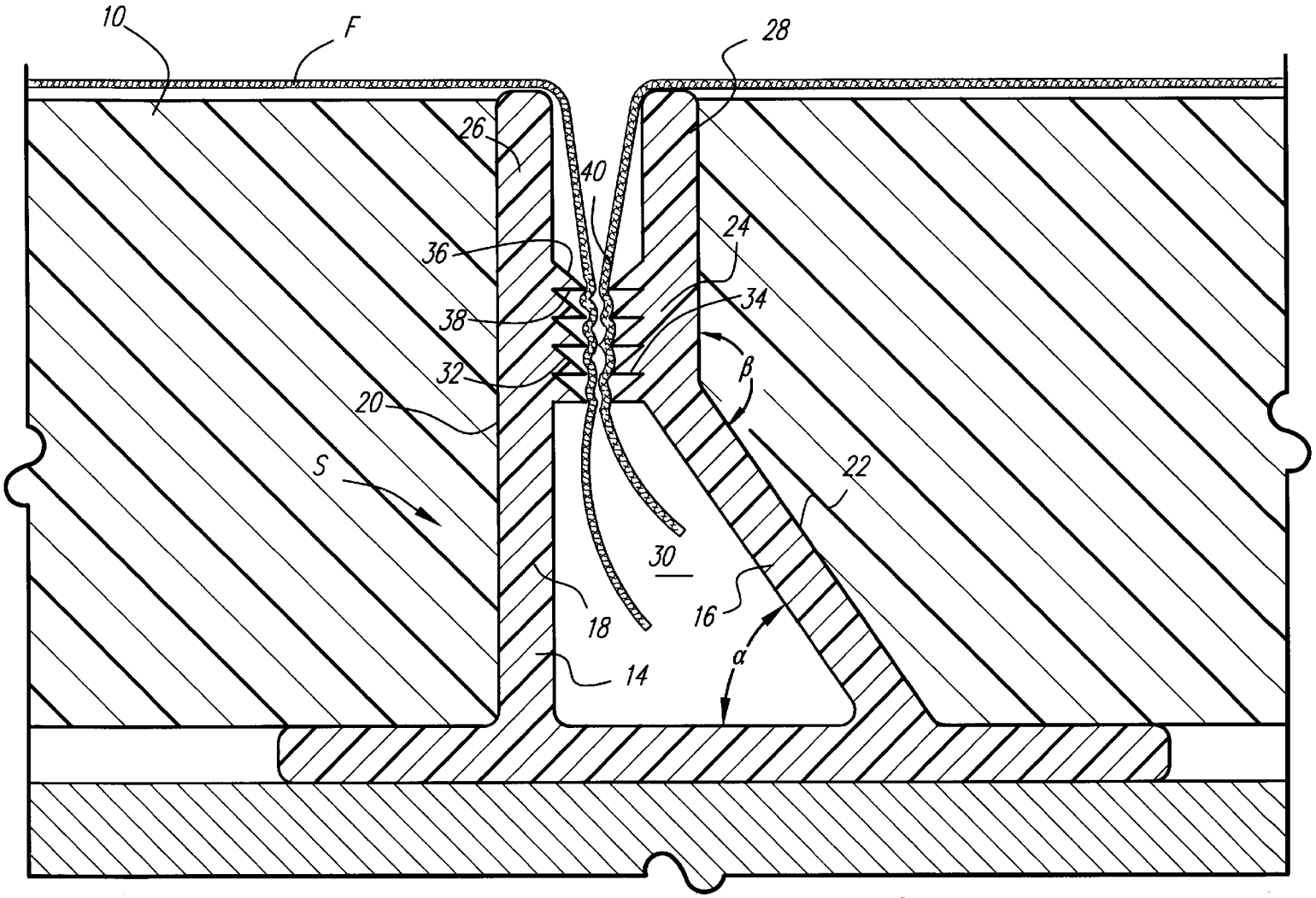
FIGS. 1–5 are fragmentary cross-sectional views of fabric cores, fabric and various embodiments of elongated molding strips for securing the fabric to a wall.

Referring to the drawing figures, particularly to FIG. 1, there is illustrated a plastic elongated molding strip illustrated in cross-section with fabric F overlying a panel core 10, the molding strip S securing the fabric F along an outer surface of the core. It will be appreciated that the molding strip S is preferably formed of an extruded plastic material and may be provided in varying lengths, with the various elements as described extending substantially the full length of the strips.

The molding strip S includes a base 12 having a first wall 14 extending generally perpendicular to the base 12 and a second wall 16 extending outwardly of the base 12. The base 12 extends laterally beyond first and second walls 14 and 16, respectively, forming with the walls seats for the panel core 10 with overlying fabric F. A flush meeting or tightly abutting condition between the non-combustible material of core 10 and the flammable plastic molding strip S is required to achieve fire safety performance that meets commercial interior fire codes. The core material shields the bulk of the flammable strip from flame.

Each of the walls 14 and 16 has a non-fabric gripping section and a gripping section. For example, wall 14 includes a non-gripping section 18 and a gripping section 20 lying on a side of non-gripping section 18 remote from base 12. Wall 16 includes a non-gripping section 22 and a gripping section 24 lying on a side of non-gripping section 22 remote from base 12. Walls 14 and 16 also include distal wall portions 26 and 28, respectively, forming between them a fabric entry slot for receiving margins of fabric F disposed along surface portions of the core. As illustrated, the non-gripping sections 18 and 22 of walls 14 and 16, respectively, together with the portion of base 12 between walls 14 and 16 define a fabric-receiving cavity 30.

In accordance with the present invention, the gripping sections 20 and 24 each have an array of teeth 32 and 34, respectively. Each of the teeth 32 and 34 have a long side 36 and a short side 38 meeting at a point or tip 40. It will be appreciated from a review of FIG. 1 that the tips of the teeth 32 on the first gripping section 20 lie in registration with opposing teeth 34 of the second gripping section 24. Consequently, the short sides 38 of teeth 32 and 34 lie in spaced parallel planes generally parallel to the base 12. Additionally, the long sides 36 of teeth 32 and 34 lie on the sides of the respective teeth remote from the fabric collection cavity 30. In the normal configuration of the teeth 32 and 34, the teeth are spaced one from the other and form a passageway through which the fabric entering the fabric inlet may pass into the collection cavity 30. The inclined long walls 36 of the teeth facilitate movement of the fabric into the fabric collection cavity. It will be recalled that the fabric is stuffed into the collection cavity by means a long-bladed knife or tool and, consequently, the angled surface of the teeth directs the tool and fabric toward the points of the teeth so that the fabric can be disposed between the teeth and into the cavities. Also, the registration of the tips of the laterally opposed teeth provides a gripping point for the fabric for each pair of teeth affording adequate retention, yet enabling removal of the fabric without damage.

As illustrated, the second wall 16 extends from base 12 at an angle to the first wall 14. That is, proximal portions of the non-gripping section 22 of second wall 16 are spaced from the proximal portion of the non-gripping section 18 of wall 14 adjacent base 12, while a distal portion of non-gripping section 22 of wall 16 lies adjacent a distal portion of the non-gripping section 18 of wall 14. The non-gripping sections 18 and 22, together with the portion of the base 12 extending between the proximal portions of walls 14 and 16 thus define a generally right triangularly configured fabric collection cavity 30. Additionally, the gripping section 24 of wall 16 extends perpendicular relative to base 12. Consequently, the angles $\alpha$ and $\beta$ on the respective inside and exterior surfaces of wall 16 are supplemental to one another. One of the significant advantages of angling the non-gripping section 22 of wall 16 from base 12 toward first wall 14 is that the angled surface requires only one cut to be made on the core instead of the typical two cuts forming a rabbet groove. That is, the inside corner edge of the core can be beveled complementary to the angle of wall 16 to accommodate the angled wall 16 and no further cuts of the edge of the core are necessary. Still further, while both walls 14 and 16 are flexible to a limited extent to enable the insertion of the fabric into the collection cavity 30, the wall 16 is more rigid and has higher resistance to fracture at the juncture of wall 16 and base 12. That is, a right angularly related wall relative to base 12 has a greater tendency to rupture or crack than an angled wall.

Figure 2:
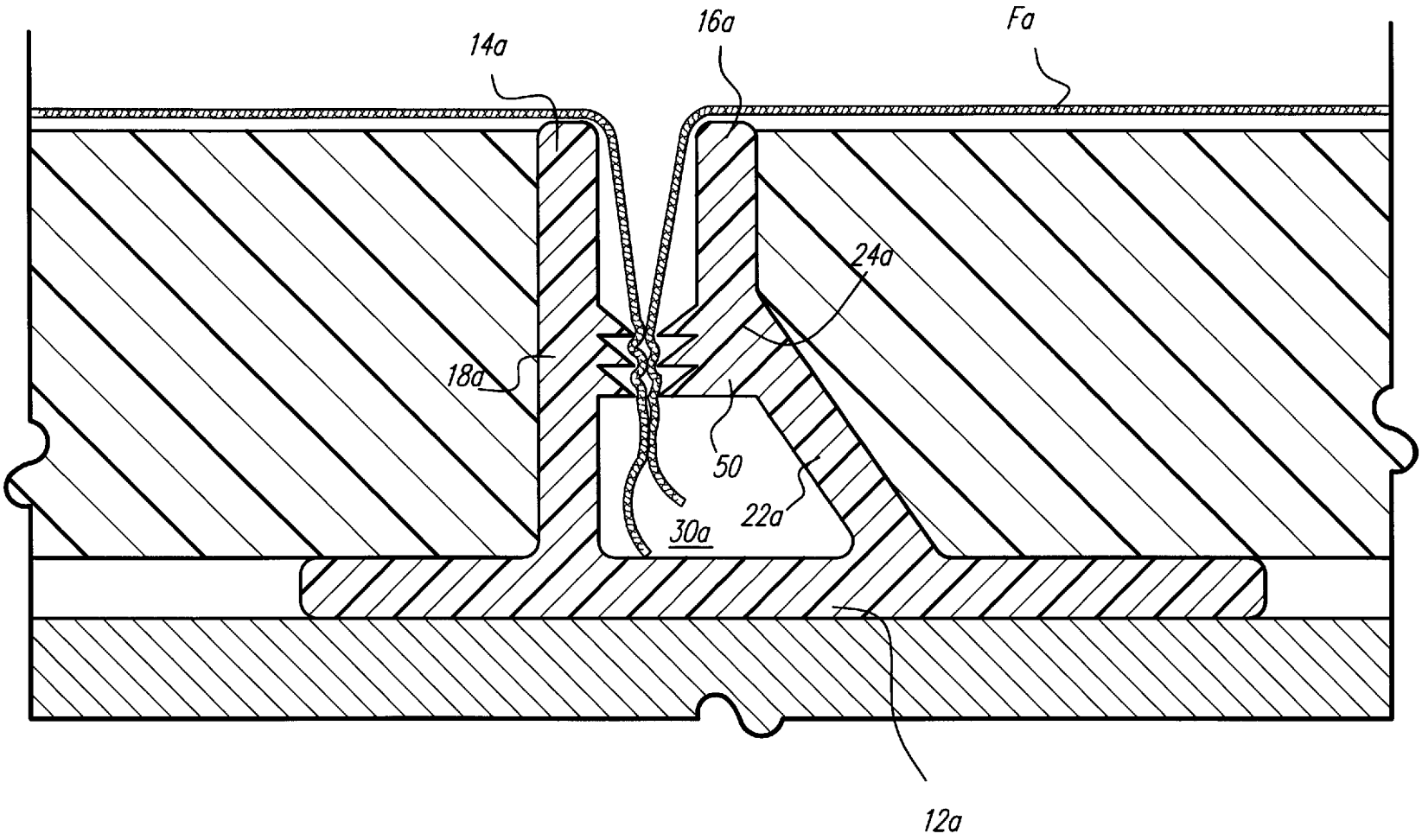

Referring to the embodiment of the invention herein illustrated in FIG. 2, wherein like reference numerals are applied to like parts, followed by the suffix "a," there is illustrated a similar type of butt joint molding strip as illustrated in FIG. 1. In this form, however, the length of the walls 14*a* and 16*a* are shorter. Additionally, the fabric collection cavity 30*a* is formed not only by the non-gripping sections 18*a* and 22*a* of walls 14*a* and 16*a*, respectively, as well as base 12*a*, but also with an extended flange 50 forming a proximal portion of the gripping section 24*a* of wall 16*a*. Consequently, the fabric collection cavity 30*a* is formed by essentially four wall portions forming a quadrilateral rather than a right triangle as in the first embodiment. The number of teeth is reduced from that shown in the first embodiment. This second embodiment is similar to the first embodiment in all other respects.

Figure 3:
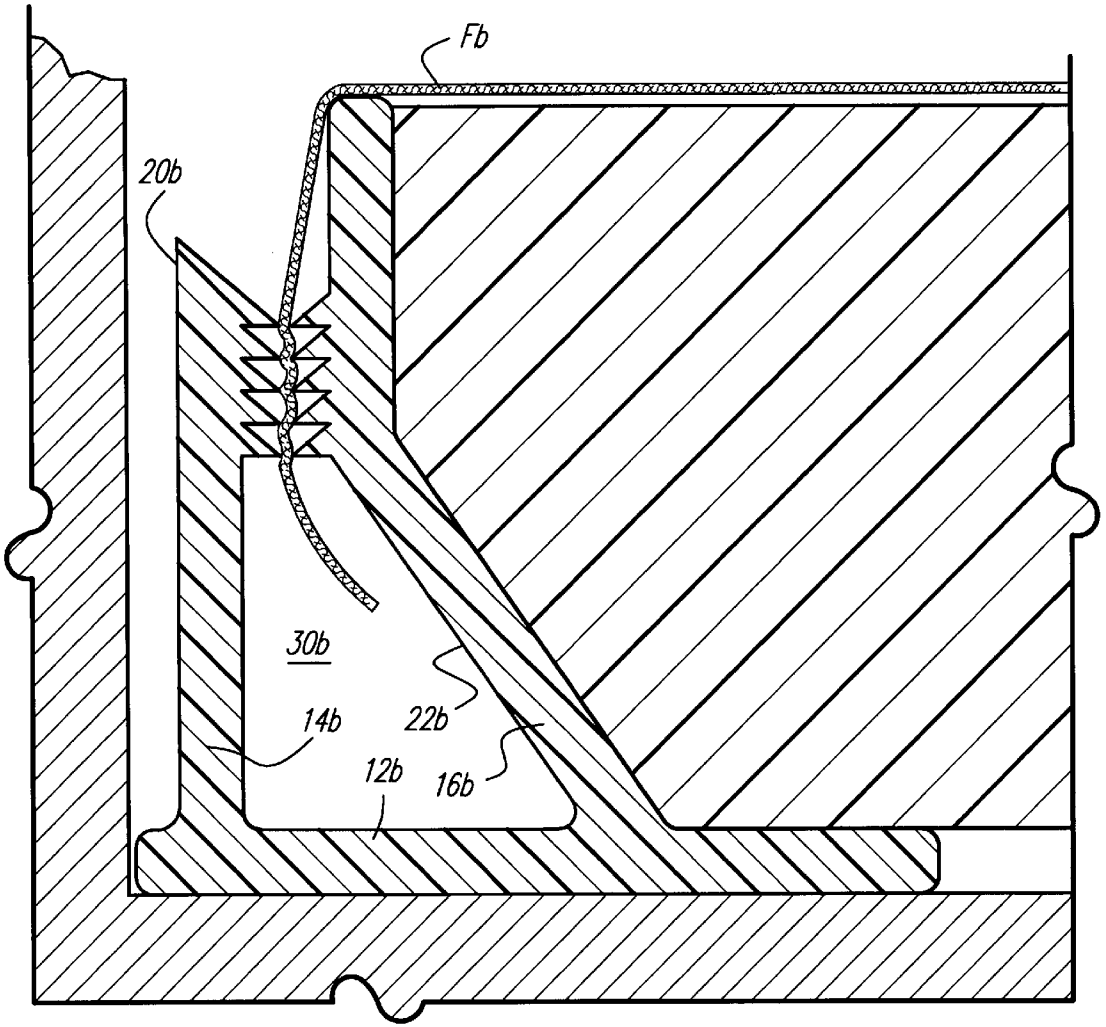

Referring to FIG. 3, wherein like reference numerals apply to like parts as in the prior embodiments, followed by the suffix "b," there is illustrated a further form of molding strip wherein the wall 14*b* is foreshortened at the outer end of the gripping section 20*b*. That is, the wall 14*b* does not include an entry wall portion similar to wall portion 26 illustrated in FIG. 1. The recessed outer end of wall 14*b* eliminates any need to apply a fabric wrap about the leg 14*b* if it was extended to lie flush with the end of the opposite wall. The non-fabric wrapped end of wall 14*b* is thus recessed to essentially conceal it from view, avoiding the necessity of wrapping it with fabric.

Figure 4:
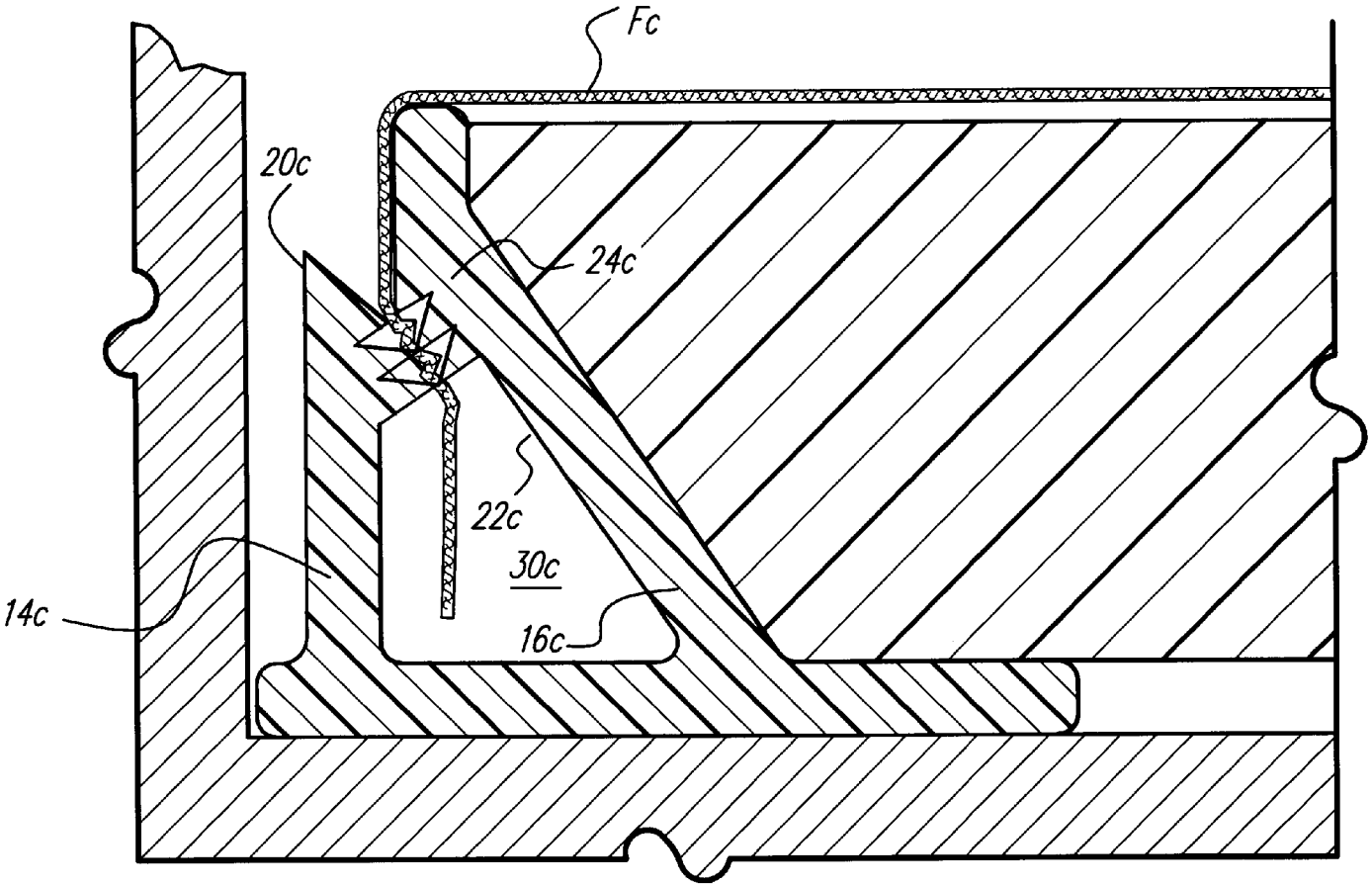

Referring now to FIG. 4, wherein like reference numerals apply to like parts as in the prior embodiments, followed by the suffix "c," the gripping portions 20*c* and 24*c* of walls 14*c* and 16*c* are reoriented to define a fabric entry slot extending at an angle relative to the base 12*c*. In the illustrated form, the fabric entry slot parallels the angle of the non-gripping section 22*c* of wall 16*c*.

Figure 5:
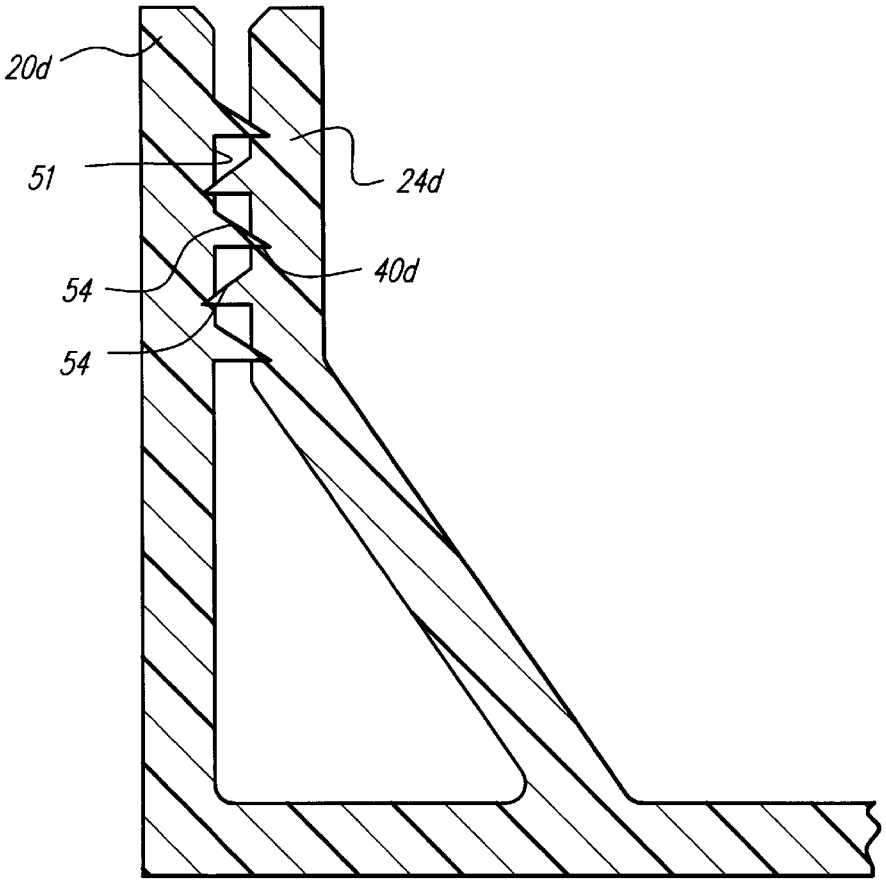

Referring now to FIG. 5, wherein like reference numerals apply to like parts as in the prior embodiments, followed by the suffix "d," the gripping sections 20*d* and 24*d* have a different arrangement of teeth than the prior embodiments. The configuration of each tooth is similar to prior embodiments, i.e., the long side of the tooth is on the opposite side of the short side of the tooth from the fabric collection cavity 30*d*. In addition, the teeth on each of the gripping sections 20*d* and 24*d* are spaced from one another by lands which lie parallel to the gripping sections. Further, the teeth do not register or align laterally with one another. Rather, the teeth on one gripping section register with the lands on the other gripping section. Also, the base of each tooth extends a distance (in the illustrated vertical direction) less than the extent of the lands between adjacent teeth on the gripping sections. In a preferred form, each of the lands between the teeth has a recess 54 for receiving the point 40*d*. Consequently, when the fabric is inserted into the fabric entry slot, the fabric will be engaged by the points of the teeth which, in turn, will insert the fabric into the recesses of the lands.

Figure 6:
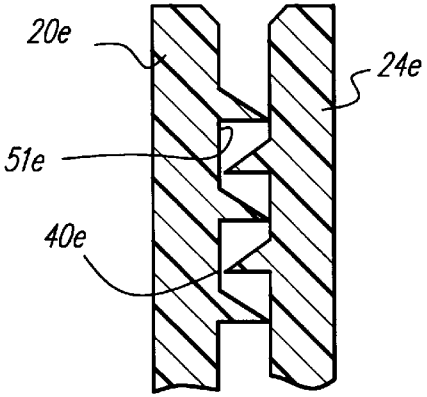
FIGS. 6 and 7 are fragmentary enlarged cross-sectional views of portions of the gripping sections of further embodiments of gripping teeth in accordance with the present invention.

Referring to FIG. 6 wherein like reference numerals are applied to like parts as in the prior embodiment, followed by the suffix "e," a similar arrangement as in FIG. 5 is illustrated, except that the lands 51*e* on the gripping sections 20*e* and 24*e* do not have recesses and the tips 40*e* of the teeth of the opposing gripping section engage the surfaces of the lands 51*e*.

Figure 7:
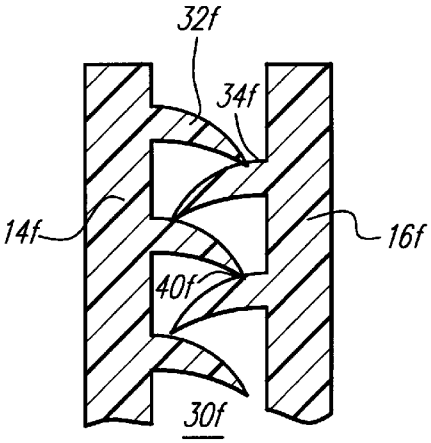

Referring to the embodiment of FIG. 7, wherein like reference numerals refer to like parts, followed by the suffix "f," the teeth 32*f* and 34*f* have long and short sides which are arcuate, the longer sides having a larger radius of curvature than the radius of curvature of the short sides. The long sides remain on the side of the teeth remote from the collection cavity 30*f*. In this embodiment, the tips 40*f* of the teeth engage the opposing teeth along the long arcuate sides thereof. Teeth of this configuration afford a greater degree of flexibility than in the prior embodiments upon inserting the fabric between the walls 14*f* and 16*f*.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A molding strip for a fabric panel, comprising:

a base;

first and second walls extending from said base, said first and second walls each having first and second gripping sections, respectively, extending generally parallel to one another and spaced away from said base by respective first and second non-gripping sections, said first and second gripping sections lying in opposition to one another, said first non-gripping section on said first wall being spaced away from said second non-gripping section on said second wall, said base and said first and second non-gripping sections defining a fabric collection cavity;

at least one of said first and second walls being movable to a position enabling fabric material to pass between said first and second gripping sections of said first and second walls, respectively, into said fabric collection cavity;

first and second fabric gripping teeth positioned on said first and second fabric gripping sections, respectively, each of said first and second fabric gripping teeth having a long side and a short side meeting at a point, said long side being relatively further away from said fabric collection cavity than said short side, the short sides of said teeth projecting from each of said first and second gripping sections in a direction substantially perpendicular to said gripping sections, said point of each tooth being generally oriented closer to said fabric collection cavity than a long side of said tooth, the points of said teeth of said first gripping section being aligned with respective points of teeth of said second gripping section in a direction generally perpendicular to said generally parallel extending gripping members.

2. A molding strip according to claim 1 wherein said second non-gripping section of said second wall extends from said base at an included angle less than 90° and toward said first wall.

3. A molding strip according to claim 2 wherein said second gripping section of said second wall forms an angle with said non-gripping section of said second wall supplemental to said included angle.

4. A molding strip according to claim 1 wherein said first and second non-gripping sections of said first and second walls, respectively, extend in non-parallel planes relative to one another, with proximal portions of said first and second non-gripping sections adjacent said base being spaced from one another a distance greater than the spacing between distal portions thereof adjacent respective first and second gripping sections.

5. A molding strip according to claim 1 wherein said fabric collection cavity is bounded by portions of said base and said first and second non-gripping portions to form a generally right triangularly-shaped fabric collection cavity relative to said base.

6. A molding strip for a fabric panel, comprising:

a base;

first and second walls extending from said base, said first and second walls having first and second gripping sections, respectively, extending generally parallel to one another and spaced away from said base by respective first and second non-gripping sections, said first and second gripping sections lying in opposition to one another, said first non-gripping section on said first wall being spaced away from said second non-gripping section on said second wall, said base and said first and second non-gripping sections defining a fabric collection cavity;

at least one of said first and second walls being movable to a position enabling fabric material to pass between said first and second gripping sections of said first and second walls, respectively, into said fabric collection cavity;

first and second fabric gripping teeth positioned on said first and second fabric gripping sections, respectively, each of said first and second fabric gripping teeth having a long side and a short side meeting at a point, said long side being relatively further away from said fabric collection cavity than said short side, said point of each tooth being generally oriented closer to said fabric collection cavity than a long side of said tooth;

said first wall having a first wall portion on an opposite side of said first gripping section from said first non-gripping section, said second wall having a second wall portion on an opposite side of said second gripping section from said second non-gripping section, said first and second wall portions defining a fabric entry slot for directing fabric between the teeth of said gripping sections;

said first and second non-gripping sections of said first and second walls, respectively, extending in non-parallel planes relative to one another, with proximal portions of said first and second non-gripping sections adjacent said base being spaced from one another a distance greater than the spacing between distal portions thereof adjacent respective first and second gripping sections.

7. A molding strip according to claim 6 wherein said second non-gripping section of said second wall extends from said base at an angle less than 90° and toward said first wall.

8. A molding strip according to claim 7 wherein said second gripping section of said second wall forms an angle with said non-gripping section of said second wall supplemental to the first-mentioned angle.

9. A molding strip according to claim 6 wherein said fabric collection cavity is bounded by portions of said base and said first and second non-gripping portions to form a generally right triangularly-shaped fabric collection cavity relative to said base.

10. A molding strip according to claim 6, said first wall having a first wall portion on an opposite side of said first gripping section from said first non-gripping section, said second wall having a second wall portion on an opposite side of said second gripping section from said second non-gripping section, said first and second wall portions defining a fabric entry slot for directing fabric between the teeth of said gripping sections, said first and second wall portions extending parallel to one another.

11. A molding strip according to claim 6, said first wall having a first wall portion on an opposite side of said first gripping section from said first non-gripping section, said second wall having a second wall portion on an opposite side of said second gripping section from said second non-gripping section, said first and second wall portions defining a fabric entry slot for directing fabric between the teeth of said gripping sections, said first and second wall portions diverging from one another in a direction away from said gripping sections.

12. A molding strip according to claim 6 wherein said teeth on each said gripping section are spaced from one another to define lands therebetween, the lands of said gripping sections lying in generally parallel spaced relation relative to one another, the points of the teeth of each gripping section lying in engagement with the lands between the teeth of another of said gripping sections, at least one of said walls being flexible, enabling the gripping section carried thereby for movement away from another of said gripping sections to permit insertion of fabric between the gripping sections with the points of the teeth of each gripping section engaging the fabric against the lands of the opposing gripping section.

13. A molding strip according to claim 12 wherein said lands have recesses, the recesses of the lands of one gripping section receiving the points of the teeth of another gripping section.

14. A molding strip according to claim 6 wherein the long side of each tooth is arcuate with the points of each tooth being directed toward the arcuate long side of opposing teeth of the opposing gripping section.

15. A molding strip for a fabric panel, comprising:

a base;

first and second walls extending from said base, said first and second walls having first and second gripping sections, respectively, extending generally parallel to one another and spaced away from said base by respective first and second non-gripping sections, said first and second gripping sections lying in opposition to one another, said first non-gripping section on said first wall being spaced away from said second non-gripping section on said second wall, said base and said first and second non-gripping sections defining a fabric collection cavity;

at least one of said first and second walls being movable to a position enabling fabric material to pass between said first and second gripping sections of said first and second walls, respectively, into said fabric collection cavity;

first and second fabric gripping teeth positioned on said first and second fabric gripping sections, respectively, each of said first and second fabric gripping teeth having a long side and a short side meeting at a point, said long side being relatively further away from said fabric collection cavity than said short side, said teeth on each said gripping section being spaced from one another to define lands therebetween, the lands of said gripping sections lying in generally parallel spaced relation relative to one another, the points of the teeth of each gripping section lying in engagement with the lands between the teeth of another of said gripping sections, at least one of said walls being flexible, enabling the gripping section carried thereby for movement away from another of said gripping sections to permit insertion of fabric between the gripping sections with the points of the teeth of each gripping section engaging the fabric against the lands of the opposing gripping section.

16. A molding strip according to claim 15 wherein the lands between the teeth of each gripping section have recessed portions for receiving the points of the teeth of the opposing gripping section.

17. A molding strip according to claim 15 wherein the teeth on each gripping section are misaligned with the teeth of the opposing gripping section.

18. A molding strip for a fabric panel, comprising:

a base;

first and second walls extending from said base, said first and second walls having first and second gripping sections, respectively, extending generally parallel to one another and spaced away from said base by respective first and second non-gripping sections, said first and second gripping sections lying in opposition to one another, said first non-gripping section on said first wall being spaced away from said second non-gripping section on said second wall, said base and said first and second non-gripping sections defining a fabric collection cavity;

at least one of said first and second walls being movable to a position enabling fabric material to pass between said first and second gripping sections of said first and second walls, respectively, into said fabric collection cavity;

first and second fabric gripping teeth, positioned on said first and second fabric gripping sections, respectively, each of said first and second fabric gripping teeth having a long side and a short side meeting at a point, said long side being relatively further away from said fabric collection cavity than said short side, said long side of each said tooth being arcuate with the points of each tooth being directed toward the arcuate long side of opposing teeth of the opposing gripping section.

* * * * *